United States Patent [19]

Watanabe et al.

[11] Patent Number: 4,924,137

[45] Date of Patent: May 8, 1990

[54] CATHODE FOR ELECTRON TUBE

[75] Inventors: Keiji Watanabe; Keiji Fukuyama; Masako Ishida; Ryo Suzuki; Masato Saito, all of Kanagawa, Japan

[73] Assignee: Mitsubishi Denki Kabushiki Kaisha, Tokyo, Japan

[21] Appl. No.: 307,709

[22] Filed: Feb. 8, 1989

[30] Foreign Application Priority Data

| | | | |
|---|---|---|---|
| Feb. 23, 1988 | [JP] | Japan | 63-40318 |
| Mar. 1, 1988 | [JP] | Japan | 63-49083 |
| Mar. 15, 1988 | [JP] | Japan | 63-62121 |
| Apr. 19, 1988 | [JP] | Japan | 63-97873 |

[51] Int. Cl.[5] ..... H01J 1/14; H01J 1/20; H01J 19/06; H01J 19/14

[52] U.S. Cl. ..... 313/337; 313/346 R

[58] Field of Search ..... 313/346 R, 337, 346 DC

[56] References Cited

U.S. PATENT DOCUMENTS

| | | | |
|---|---|---|---|
| 3,719,856 | 3/1973 | Koppius | 313/346 R X |
| 4,350,920 | 9/1982 | Bertens | 313/346 R |
| 4,797,593 | 1/1989 | Saito et al. | 313/346 R |

FOREIGN PATENT DOCUMENTS

| | | |
|---|---|---|
| 60-160851 | 7/1985 | Japan . |
| 60-229303 | 10/1985 | Japan . |

*Primary Examiner*—Palmer C. DeMeo

*Attorney, Agent, or Firm*—Lowe, Price, LeBlanc, Becker & Shur

[57] ABSTRACT

An oxide-coated cathode for an electron tube comprises a layer (2) of an electron-emissive substance. This layer (2) contains: an alkaline earth metal oxide as a principal component containing at least Ba; an oxide of Sc; and at least one heat-resisting oxide selected from the group consisting of oxides of Al, Si, Ta, V, Cr, Fe, Zr, Nb, Hf, Ta, Mo and W.

9 Claims, 3 Drawing Sheets

CATHODE FOR ELECTRON TUBE

CROSS-REFERENCE TO RELATED, COPENDING APPLICATION

A related copending application of particular interest to the present application is U.S. Ser. No. 886,777 filed on July 17, 1986 under the title "Cathode for Electron Tube" and assigned to the same assignee of the present application, now U.S. Pat. No. 4,797,593.

BACKGROUND OF THE INVENTION

1. Field of the Invention

This invention relates to cathodes for electron tubes such as cathode-ray tubes of TV sets and particularly to an improvement in electron emission characteristics of an oxide-coated cathode.

2. Description of the Background Art

FIG. 1 is a sectional view schematically showing a conventional oxide-coated cathode for used in a cathode-ray tube or an image pickup tube for a TV system. In the conventional oxide-coated cathode, an electron-emissive substance layer 2 made of alkaline earth metal oxides containing at least Ba and further containing Sr and/or Ca is formed on a cylindrical base 1 made of Ni as a major element containing a small amount of a reducing element such as Si or Mg. A heater 3 is provided inside the base 1 and the electron-emissive layer 2 is heated by the heater 3 to emit thermal electrons. At this time, main donors for the emission of thermal electrons are free Ba reduced by Si, Mg or the like.

Such a conventional cathode is manufactured by a process as described below. First, a suspension of carbonates of alkaline earth metals (Ba, Sr, Ca, etc.) is applied on the base 1 and heated in vacuum by the heater 3. As a result, the alkaline earth metal carbonates are converted to oxides. Then, the alkaline earth metal oxides are partially reduced at a high temperature of 900° to 1100° C. so that they are activated to have a semiconductive property, whereby the electron-emissive layer 2 made of alkaline earth metal oxide is formed on the base 1.

In the above described activation process, reducing elements such as Si and Mg contained in the base 1 diffuse to move toward the interface between the alkaline earth metal oxide layer 2 and the base 1, and then react with the alkaline earth metal oxides. For example, if the alkaline earth metal oxide is barium oxide (BaO), the reaction is expressed by the following formula (1) or (2).

$$BaO+\tfrac{1}{2}Si=Ba+\tfrac{1}{2}SiO_2 \quad (1)$$

$$BaO+Mg=Ba+MgO \quad (2)$$

Thus, the alkaline earth metal oxide layer 2 formed on the base 1 is partially reduced to become a semiconductor of an oxygen deficient type. Consequently, an emission current of 0.5 to 0.8 A/cm$^2$ is obtained under the normal condition at an operation temperature of 700° to 800° C. However, in the cathode thus formed, a current density higher than 0.5 to 0.8 A/cm$^2$ can not be obtained for the following reasons. As a result of the partial reduction of the alkaline earth metal oxides, an interface layer of oxides or composite oxides such as $SiO_2$, MgO, and $BaO.SiO_2$ is formed in the interface region between the base 1 and the alkaline earth metal oxide layer 2 as is obvious from the formulas (1) and (2).

Particularly, the interface layer tends to be formed at nickel crystal grain boundaries near the interface region and at a position of about 10 μm from the interface into the electron-emissive layer 2. This interface layer is a layer of a high resistance which obstructs flow of current. In addition, it is believed that the interface layer prevents the reducing element in the base 1 from diffusing into the electron-emissive layer 2, and thus, prevents formation of a sufficient amount of Ba for emitting thermal electrons.

Japanese Patent Application No. 229303/1985 discloses a cathode comprising a base 1 of Ni containing a rare earth metal of 0.1 to 0.5 wt. %. In this cathode, oxidation of the base 1 is prevented when alkaline earth metal carbonates are decomposed to form the electron-emissive layer 2 or when barium oxide is reduced during operation of the cathode. In addition, an interface layer of composite oxides is prevented from being formed in a concentrated manner near the interface between the base 1 and the electron-emissive layer 2, and the composite oxides is formed in a diffused manner in the electron-emissive layer 1. Accordingly, a moderate diffusion of the reducing element such as Si or Mg is maintained. As a result, there is less deterioration of the electron emission characteristics in operation of the cathode even at a high current density of about 1 to 2 A/cm$^2$.

Japanese Patent Application No. 160851/1985 discloses a cathode comprising an electron-emissive layer 2 containing a rare earth metal oxide of 0.1 to 20 wt. %. Also in this cathode, oxidation of the base 1 is prevented and formation of an interface layer is prevented. The electron emission characteristics of this cathode are little deteriorated in operation even at a high current density of 2A/cm$^2$ as in the above mentioned cathode. However, a further improvement is still required. More specifically, if the cathode after the normal activation process is operated at a high current density of more than 2A/cm$^2$, it happens that free Ba is considerably evaporated to deteriorate the electron emission characteristics.

SUMMARY OF THE INVENTION

In view of the above described prior art, an object of this invention is to provide an oxide-coated cathode for an electron tube, having stable emission characteristics in operation at a current density higher than 2A/cm$^2$.

An oxide-coated cathode for an electron tube according to an aspect of the invention comprises: a base containing Ni as a major element; a reducing agent contained in the base; an electron-emissive substance layer formed on the base, containing (a) an alkaline earth metal oxide as a principal component containing at least Ba, (b) a compound of Sc, and (c) at least a heat-resisting oxide selected from the group consisting of oxides of Al, Si, Ti, V, Cr, Fe, Zr, Nb, Hf, Ta, Mo, and W; and a heater for heating the electron-emissive layer.

An oxide-coated cathode for an electron tube according to another aspect of the invention comprises: a base containing Ni as a major element; a reducing agent contained in the base; a first electron-emissive layer containing (a) an alkaline earth metal oxide as a principal component containing at least Ba, and (b) a compound of Sc; a second electron-emissive layer formed on the first electron-emissive layer, containing (c) an alkaline earth metal oxide as a principal component containing at least Ba, and (d) at least one heat-resisting oxide selected from the group consisting of oxides of Al, Si, Ti, V, Cr, Fe, Zr, Nb, Hf, Ta, Mo and W; and a heater for heating the first and second electron-emissive layers.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
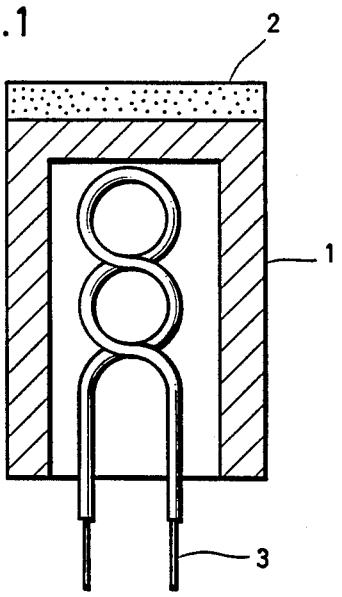
FIG. 1 is a schematic sectional view illustrating a structure of an oxide-coated cathode for an electron tube.

Referring to FIG. 1, a cathode according to an embodiment of the invention comprises a base 1 including Ni as a major element containing a small amount of a reducing element such as Si or Mg, and a heater 3 in the same manner as in the conventional cathodes. An electron-emissive layer 2 in the cathode of this embodiment contains not only triple alkaline earth metal oxides of Ba, Sr and Ca and a scandium oxide, but also at least one heat-resisting oxide selected from the group consisting of oxides of Al, Si, Ti, V, Cr, Fe, Zr, Nb, Hf, Ta, Mo and W. Those alkaline earth metal oxides are formed by decomposing carbonates as in the prior art and the oxides thus obtained are partially reduced and activated.

Figure 2:
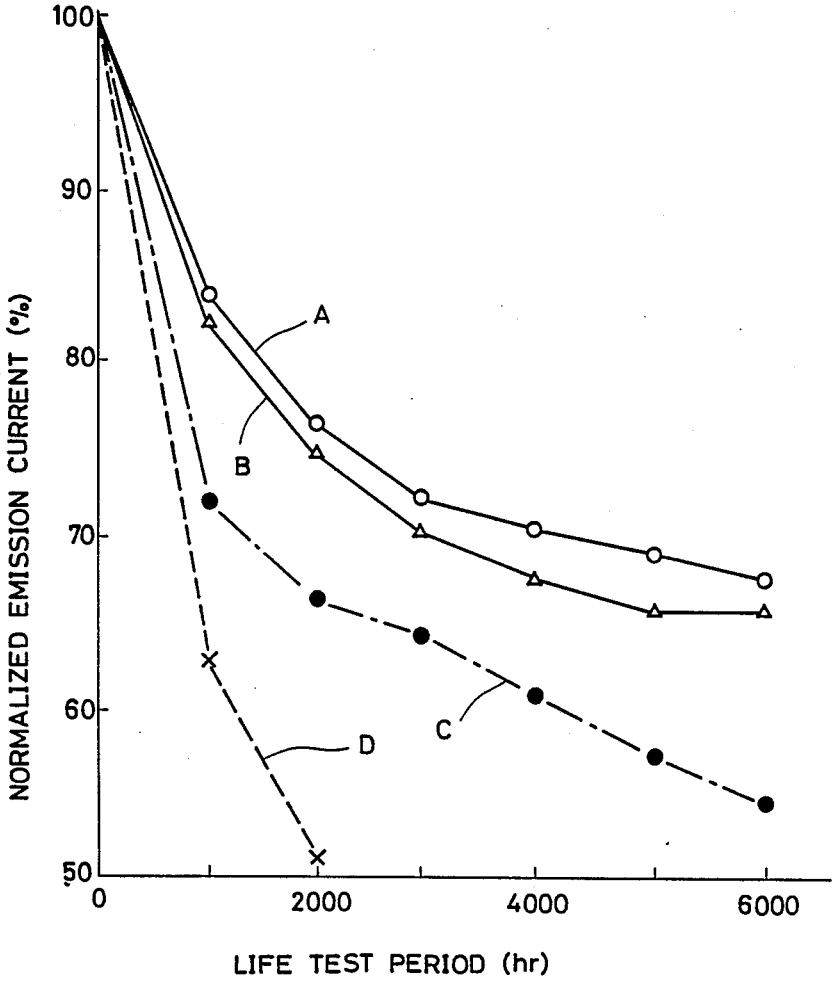
FIG. 2 is a graph showing relation between the life test period and the emission current in cathodes according to an embodiment of the invention.

Referring to FIG. 2 there are shown deterioration curves of electron emission characteristics of cathodes according to the embodiment. Those cathodes are incorporated in diode bulbs so as to be subjected to life tests at a high current density of 2.5 A/cm$^2$ and changes in the emission current under the normal condition after the tests were examined. The curve A represents a deterioration of the electron emission characteristics in a cathode comprising an electron-emissive layer 2 of an alkaline earth metal oxide of Ba, Sr, and Ca containing scandium oxide ($Sc_2O_3$) of 4 wt. % and heat-resisting titanium oxide ($TiO_2$) of 4 wt. %. The curve B represents a deterioration of the electron emission characteristics in a cathode containing heat-resisting chromium oxide ($Cr_2O_3$) of 4 wt. % in place of $TiO_2$. For comparison, the curve C represents a deterioration of the electron-emissive characteristics of a cathode containing $Sc_2O_3$ of 4 wt. % but not containing $TiO_2$ nor $Cr_2O_3$ and the curve D represents a deterioration of the electron emission characteristics of a cathode not containing any of $Sc_2O_3$, $TiO_2$ and $Cr_2O_3$. As is evident from those curves, it is understood that the cathodes containing the heat-resisting oxide $Ti_2O_3$ or $Cr_2O_3$ in addition to $Sc_2O_3$ exhibit less deterioration in the electron emission characteristics during operation at a high current density, compared with the cathodes of the prior art. It is believed that this improvement is obtained because added $TiO_2$ or $Cr_2O_3$ prevents evaporation of free Ba as donor for thermionic emission.

As a result of observation of the surface of the electron-emissive layer 2 containing $TiO_2$ or $Cr_2O_3$ by using the Auger spectral analysis method, it was found that a sufficient amount of Ba exists on particles of $TiO_2$ or $Cr_2O_3$. Generally, if high current flows in the electron-emissive layer 2, temperature rises due to Joule heat and an evaporated amount of Ba increases. Accordingly, the increase of the evaporated Ba results in a short life of the cathode. In other words, it is believed that the oxide $TiO_3$ or $Cr_2O_3$ absorbs Ba and prevents evaporation thereof, thus, prolonging the life of the cathode even after operation at a high current density.

As a result of conducting experiments as to amounts of addition of $Sc_2O_3$, $TiO_2$ and $Cr_2O_3$, it was found that the addition amounts are preferably 0.1 to 20 wt. % for $Sc_2O_3$ and 0.5 to 10 wt. % for $TiO_2$ and/or $Cr_2O_3$. More specifically, if the amount of $Sc_2O_3$ exceeds 20 wt. %, the initial emission current is lowered and if it is less than 0.1 wt. %, an interface layer can not be effectively prevented from being formed. If $TiO_2$ or $Cr_2O_3$ exceeds 10 wt. %, the initial emission current is also lowered and if it is less than 0.5 wt. % conversely, evaporation of Ba can not be effectively prevented. $Al_2O_3$, $SiO_2$, $V_2O_5$, $Fe_2O_3$, $ZrO_2$, $Nb_2O_5$, $HfO_2$, $Ta_2O_5$, $MoO_3$ or $WO_3$ for example may be used in place of $TiO_2$ and/or $Cr_2O_3$.

Figure 3:
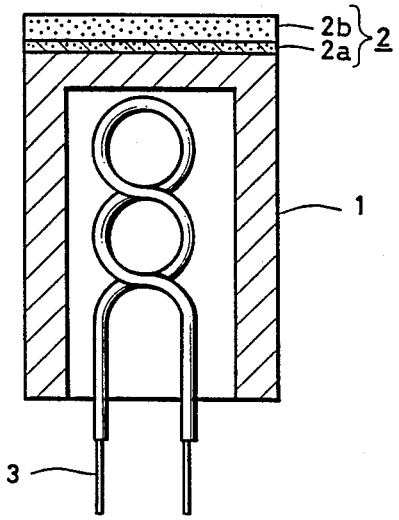
FIG. 3 is a schematic sectional view illustrating a structure of a cathode according to another embodiment of the invention.

Referring to FIG. 3, there is shown a structure of a cathode according to another embodiment of the invention. The cathode of FIG. 3 is similar to that of FIG. 1, except that the electron-emissive layer 2 in FIG. 3 includes a first sub layer **2*a* and a second sub layer 2*b***.

Those sub layers can be manufactured by the below described process. First, in order to form the first sub layer **2*a*, a first suspension is prepared by adding and mixing scandium oxide of 50 wt. % (wt. % after barium carbonate has been converted to an oxide) into a carbonate of Ba. This suspension is applied on the base 1 to a thickness of about 10 μm by using a spray. Then, in order to form the second sub layer 2*b*, a second suspension is prepared by mixing $TiO_2$ or $Cr_2O_3$ of 4 wt. % into carbonates of Ba, Sr and Ca. This second suspension is applied on the first suspension layer to a thickness of about 90 μm. After that, the carbonates are decomposed in vacuum and an activation process is applied, whereby the cathode of FIG. 3** is completed.

Figure 4:
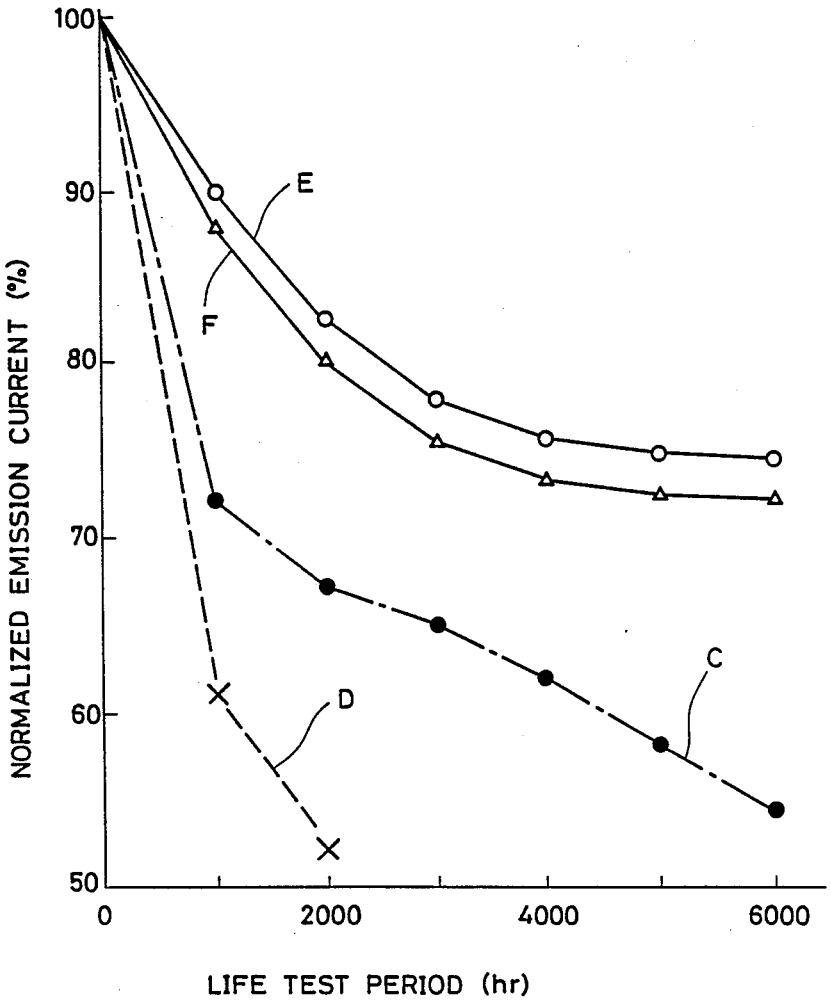
FIG. 4 is a graph showing the relation between the life test period and the emission current in cathodes having the structure of FIG. 3.

FIG. 4 shows the results of life test at a high current density of 2.5 A/cm$^2$ for cathodes thus manufactured. The curve E represents a deterioration of the electron emission characteristics in the cathode including the first sub layer of BaO-50 wt. % $Sc_2O_3$ and the second sub layer of (Ba.Sr.Ca)O-4 wt. % $TiO_2$. The curve F represents a deterioration of the electron emission characteristics in the cathode including the second sub layer of (Ba.Sr.Ca)O-4 wt. % $Cr_2O_3$ in place of (Ba.Sr.Ca)O-4 wt. % $TiO_2$. The curves C and D in FIG. 4 are the same as in FIG. 2. As is clear from FIG. 4, it is understood that the cathodes as shown in FIG. 3 exhibit less deterioration in the electron emission characteristics during operation at a high current density compared with the conventional cathodes.

The first sub layer may contain an alkaline earth metal oxide containing at least Ba, and $Sc_2O_3$ and accordingly it may further contain an oxide of Sr or Ca. The thickness of the first sub layer is preferably less than 50 μm and more preferably 10 to 20 μm. This is because if the first sub layer **2*a* has a large thickness, the distance for the reducing agents Si and/or Mg in the base 1** to migrate to the second sub layer becomes long. In addition, since the first sub layer is sufficiently thin and a sufficient amount of free Ba is formed in the second sub layer, the initial emission current is not lowered even if $Sc_2O_3$ of more than 20 wt. % is contained in the first sub layer.

On the other hand, the heat-resisting oxide in the second sub layer is contained preferably in the range from 0.05 to 10 wt. % in order to avoid lowering of the initial emission current.

In the above described embodiments, a small amount of metal powder of Ni, Co, Fe, Al, Ti, Zr, Hf, Nb, Ta, Mo, W, Mg, Re, Os, Ir, Pt, Pd, Rh, Au, V, Cr, Mn, Cu, Zn, Bi and the like may be added into the electron-emissive layers 2, 2*a* and 2*b* and then conductivity of the electron-emissive layers can be improved.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An oxide-coated cathode for an electron tube, comprising:

a base (1) containing Ni as a major element, said base having an external surface;

a reducing agent contained in said base (1)

a layer (2) of an electron-emissive substance formed on a part of said external surface and containing (a) an alkaline earth metal oxide as a principal component containing at least Ba, (b) a compound of Sc, and (c) at least one heat-resisting oxide selected from the group consisting of oxides of Al, Si, Ti, V, Cr, Fe, Zr, Nb, Hf, Ta, Mo and W; and a heater (3) for heating said layer (2) of the electron-emissive substance.

2. The cathode of claim 1, wherein said compound of Sc is $Sc_2O_3$ in the range from 0.1 to 20 wt. %.

3. The cathode of claim 1, wherein said heat-resisting oxide is contained in the range from 0.05 to 10 wt. %.

4. The cathode of claim 1, wherein said layer of the electron-emissive substance contains a small amount of metal powder for improving conductivity.

5. An oxide-coated cathode for an electron tube, comprising:

a base (1) containing Ni as a major element, said base having an external surface;

a reducing agent contained in said base (1);

a first electron-emissive layer (2*a*) formed on a part of said external surface and containing (a) an alkaline earth metal oxide containing at least Ba, and (b) a compound of Sc;

a second electron-emissive layer formed on said first electron-emissive layer and containing (c) an alkaline earth metal oxide as a principal component containing at least Ba, and (d) at least one heat-resisting oxide selected from the group consisting of oxides of Al, Si, Ta, V, Cr, Fe, Zr, Nb, Hf, Ta, Mo, and W; and a heater (3) for heating said first and second electron-emissive layers (2*a*), (2*b*).

6. The cathode of claim 5, wherein said first electron-emissive layer has preferably a thickness of less than 50 μm.

7. The cathode of claim 6, wherein said first electron-emissive layer has more preferably a thickness in the range from 10 to 20 μm.

8. The cathode of claim 5, wherein said heat-resisting oxide is contained in said second electron-emissive layer in the range from 0.05 to 10 wt. %.

9. The cathode of claim 5, wherein at least either said first electron-emissive layer or said second electron-emissive layer contains a small amount of metal powder to improve conductivity.

* * * * *